US008215060B2

(12) United States Patent
Sasaki et al.

(10) Patent No.: US 8,215,060 B2
(45) Date of Patent: Jul. 10, 2012

(54) WINDOW REGULATOR

(75) Inventors: Kazuyuki Sasaki, Yokohama (JP); Yosuke Kitamura, Yokohama (JP); Yasunori Nakajima, Yokohama (JP)

(73) Assignee: Mitsui Mining and Smelting Co., Ltd., Tokyo (JP)

( * ) Notice: Subject to any disclaimer, the term of this patent is extended or adjusted under 35 U.S.C. 154(b) by 451 days.

(21) Appl. No.: 12/461,233

(22) Filed: Aug. 5, 2009

(65) Prior Publication Data

US 2010/0031576 A1 Feb. 11, 2010

(30) Foreign Application Priority Data

Aug. 8, 2008 (JP) ..... 2008-205376

(51) Int. Cl.
*E05D 13/00* (2006.01)

(52) U.S. Cl. ..... 49/322; 49/352

(58) Field of Classification Search ..... 49/348, 49/349, 322, 352
See application file for complete search history.

(56) References Cited

U.S. PATENT DOCUMENTS

| | | | | |
|---|---|---|---|---|
| 3,188,698 | A * | 6/1965 | Zoll et al. | 49/322 |
| 4,440,354 | A * | 4/1984 | Kobayashi et al. | 242/388.8 |
| 5,375,375 | A * | 12/1994 | Lee | 49/352 |
| 5,461,826 | A * | 10/1995 | Heckel et al. | 49/28 |
| 5,528,861 | A * | 6/1996 | Beyerlein | 49/352 |
| 5,673,515 | A * | 10/1997 | Weber et al. | 49/352 |
| 6,050,029 | A * | 4/2000 | Simon et al. | 49/352 |
| 7,472,515 | B2 * | 1/2009 | Mazouzi et al. | 49/352 |
| 7,484,332 | B2 * | 2/2009 | Hormann et al. | 49/322 |
| 7,743,555 | B2 * | 6/2010 | Smith | 49/352 |
| 8,001,726 | B2 * | 8/2011 | Fassbender | 49/352 |
| 2003/0041520 | A1 * | 3/2003 | Mullet | 49/322 |
| 2003/0051409 | A1 * | 3/2003 | Bruns | 49/322 |

FOREIGN PATENT DOCUMENTS

| | | | |
|---|---|---|---|
| JP | S58-181780 | U | 12/1983 |
| JP | H4-17742 | Y2 | 4/1992 |
| JP | 2002-322865 | A | 11/2002 |
| JP | 4060262 | | 6/2005 |

OTHER PUBLICATIONS

The Official Action issued May 25, 2010, in the counterpart Chinese patent application.

* cited by examiner

*Primary Examiner* — Jerry Redman
(74) *Attorney, Agent, or Firm* — The Nath Law Group; Jerald L. Meyer; Stanley N. Protigal

(57) ABSTRACT

A window regulator includes a carrier. The carrier includes a holding section and is capable slide along a guide rail with the holding section slidably contacting on the guide rail. The carrier supports a window panel. A brake mechanism is provided on the carrier. The brake mechanism prevents the window panel (the carrier) from self-weight drop by slidably contacting onto the guide rail by an urging force thereof. According to the window regulator, good down operations of the window panel can be maintained even if a slidably contacting portion(s) of the holding section that holds the guide rail becomes worn.

4 Claims, 11 Drawing Sheets

WINDOW REGULATOR

BACKGROUND OF THE INVENTION

1. Field of the Invention

The present invention relates to a window regulator for moving a window panel up and down.

2. Description of Related Art

A wire-driving type window regulator is known as a conventional window regulator applied to a door assembly of a vehicle (for example, a window regulator disclosed in Japanese Patent Publication No. 4060262: Patent Document 1). Such a wire-driving type window regulator includes a guide rail extending vertically, a carrier (carrier plate) that is coupled with the guide rail and supports a window panel, and a rotor drum connected with the carrier plate by wires for moving the window panel up (up-wire) and a wire for down (down-wire).

The window regulator moves the carrier that holds the window panel upward along the guide rail by winding up the up-wire around the rotor drum and feeding out the down-wire from the rotor drum, so that the window panel is moved upward due to a tractive power of the up-wire. On the other hand, the window regulator moves the carrier that holds the window panel downward along the guide rail by winding up the down-wire around the rotor drum and feeding out the up-wire from the rotor drum, so that the window panel is moved downward due to a tractive power by the down-wire.

In this type of a window regulator, the carrier has a holding section that is slidably coupled with the guide rail. The holding section is formed to be coupled with the guide rail with looseness (a gap) therebetween. The window panel can be smoothly moved up and down due to the looseness, because the looseness can tolerate erratic variation of thickness of the guide rail and error margins inevitably brought on assembling a door.

SUMMARY OF THE INVENTION

However, abrasion in the holding section of the carrier may become advanced after long use of the window regulator, thus the looseness between the holding section and the guide rail becomes large. As a result, a sliding friction between the holding section and the guide rail may reduce. In such a condition, the window panel may creep down due to its weight when the down-wire is wound around the rotor drum and the up-wire is fed from the rotor drum in order to move the full-closed window panel downward. Since the sliding friction between the holding section and the guide rail decreases, the window panel drops (self-weight drop) due to not the tractive power of the down-wire but its weight when the up-wire is loosen. Therefore, a vehicle passenger feels anomalous because down speed or down movement goes wrong.

In addition, vibrations (judders) of the window panel occur and thereby they cause noises when down movement of the window panel due to self-weight drop and that due to the tractive power of the down-wire are alternately repeated on moving the window panel downward. Therefore, a vehicle passenger also feels anomalous due to the vibrations and the noises.

In the above-mentioned Patent Document 1, although techniques for restraining superfluous looseness between the carrier and the guide rail are described, techniques for solving disturbance of down speed or down movement of the window panel are not described.

Therefore, a purpose of the present invention is to provide a window regulator that can maintain good down operations of the window panel even if a slidably contacting portion(s) of the carrier that contacts with the guide rail becomes worn.

A first aspect of the present invention provides a window regulator that includes a guide rail extending vertically; a carrier for supporting a window panel, the carrier including a holding section slidably coupled with the guide rail and being capable of slide along the guide rail; a drive unit connected with the carrier by a wire for moving the carrier along the guide rail by drawing the wire; and a brake mechanism provided on the carrier for preventing the window panel from self-weight drop by slidably contacting on the guide rail by an urging force thereof.

According to the first aspect of the present invention, the brake mechanism provided on the carrier slidably contacts on the guide rail by the urging force for preventing the window panel from the self-weight drop. Therefore, even if a slidably contacting portion(s) (holding section) of the carrier that contacts with the guide rail becomes worn, the self-weight drop of the window panel is prevented and thereby good down operations of the window panel can be maintained.

It is preferable that the brake mechanism includes a brake shoe capable of being pressed onto the guide rail, and a first urging member for pressing the brake shoe toward the guide rail to press the brake shoe on the guide rail by the urging force thereof.

It is further preferable that the first urging member is a leaf spring that includes two pressing sections each pressing the brake shoe.

A second aspect of the present invention provides a window regulator that includes a guide rail extending vertically; a carrier for supporting a window panel; a drive unit; and an anti-loose mechanism. The carrier includes a holding section slidably coupled with the guide rail and being capable of slide along the guide rail. The drive unit includes a rotor drum connected with the carrier by an up-wire and a down-wire. In addition, the derive unit is capable of (i) moving the carrier upward along the guide rail by winding up the up-wire around the rotor drum and feeding out the down-wire from the rotor drum or (ii) moving the carrier downward along the guide rail by winding up the down-wire around the rotor drum and feeding out the up-wire from the rotor drum. The anti-loose mechanism is provided on a string path of the up-wire between drive unit and the carrier for holding the up-wire to prevent the up-wire from coming loose at a section between a held point of the up-wire and the carrier.

According to the second aspect of the present invention, the anti-loose mechanism provided on a string path of the up-wire between drive unit and the carrier holds the up-wire to prevent the up-wire from coming loose at a section between a held point of the up-wire and the carrier and thereby the window panel can be prevented from the self-weight drop. Therefore, even if a slidably contacting portion(s) (holding section) of the carrier that contacts with the guide rail becomes worn, the self-weight drop of the window panel is prevented and thereby good down operations of the window panel can be maintained.

It is preferable that the anti-loose mechanism includes a second urging member, and a pair of holding members for holding the up-wire therebetween by an urging force by the second urging member.

DETAILED DESCRIPTION OF THE EMBODIMENTS

[First Embodiment]

A first embodiment of the present invention will be described hereinafter with reference to FIGS. 1 to 10. Note that a portion of a door is cutout in FIG. 1 in order to show an internal mechanism thereof.

Figure 1:
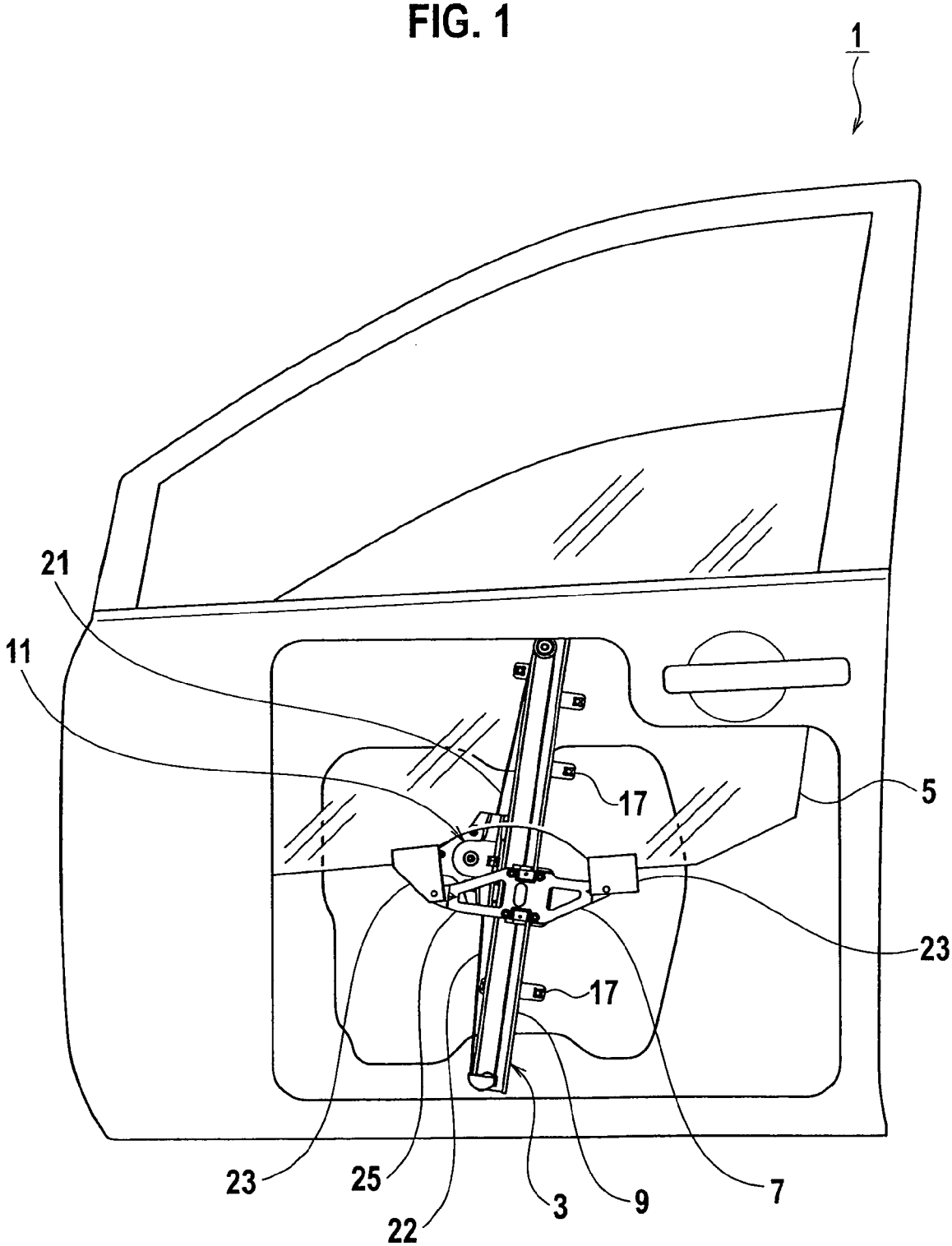
FIG. 1 is a side view showing a door assembly having a window regulator according to a first embodiment of the present invention.

As shown in FIG. 1, the door 1 of a vehicle such as an automobile houses a window regulator 3 for move a window panel 5 therein. The door 1 is a side door to be installed on a side of the vehicle. For example, the window panel 5 is made of glass.

Figure 2:
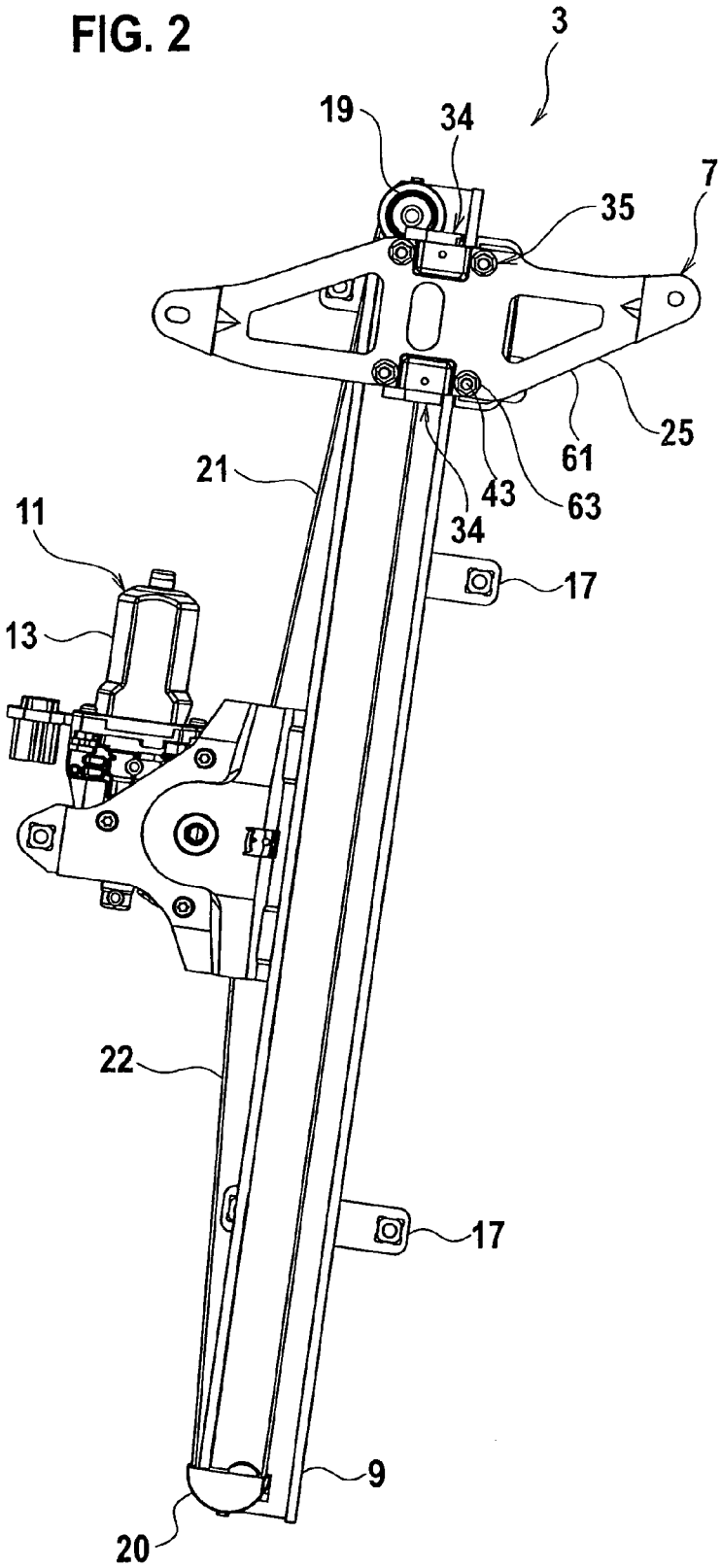
FIG. 2 is a side view (seen from an outside of a vehicle) of the window regulator according to the first embodiment of the present invention.
Figure 3:
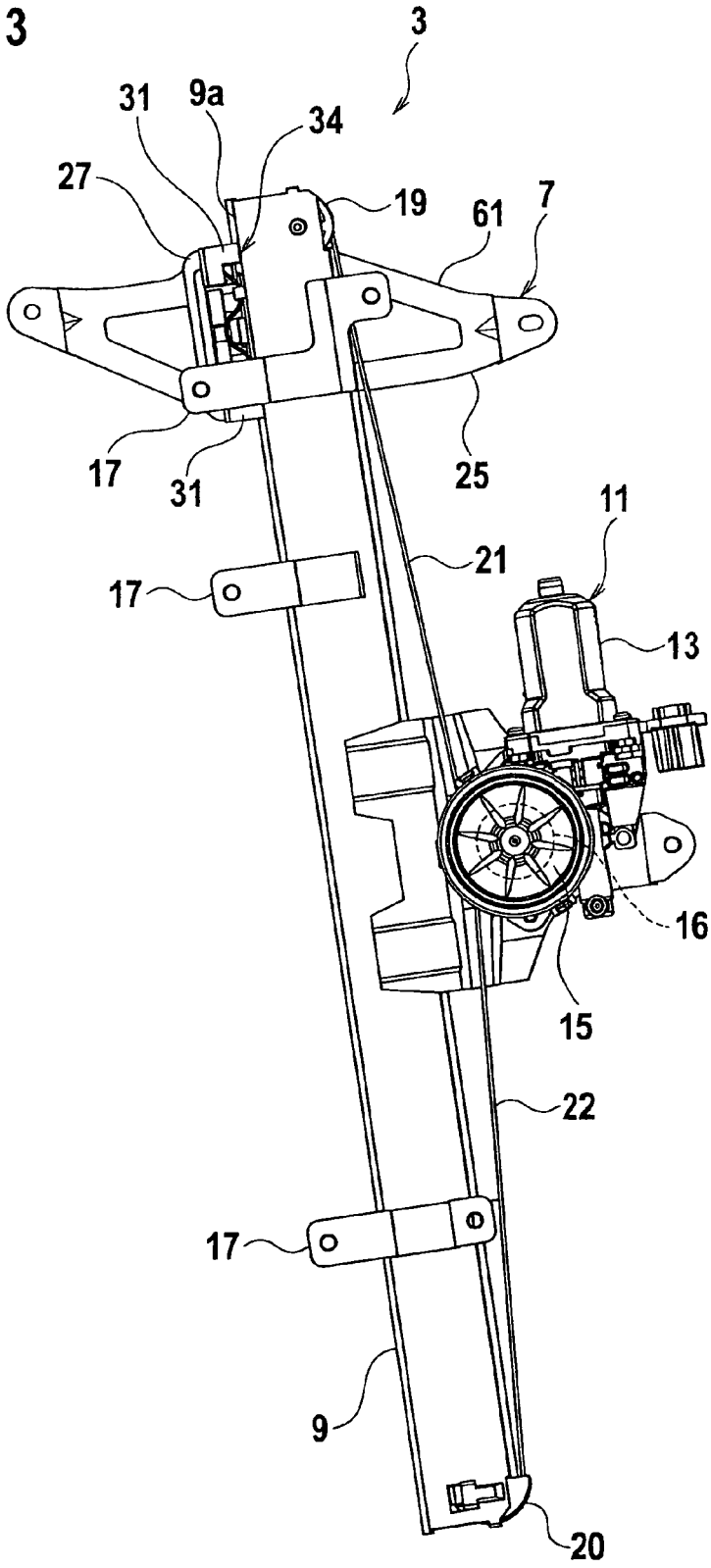
FIG. 3 is a side view (seen from an inside of the vehicle) of the window regulator according to the first embodiment of the present invention.
Figure 4:
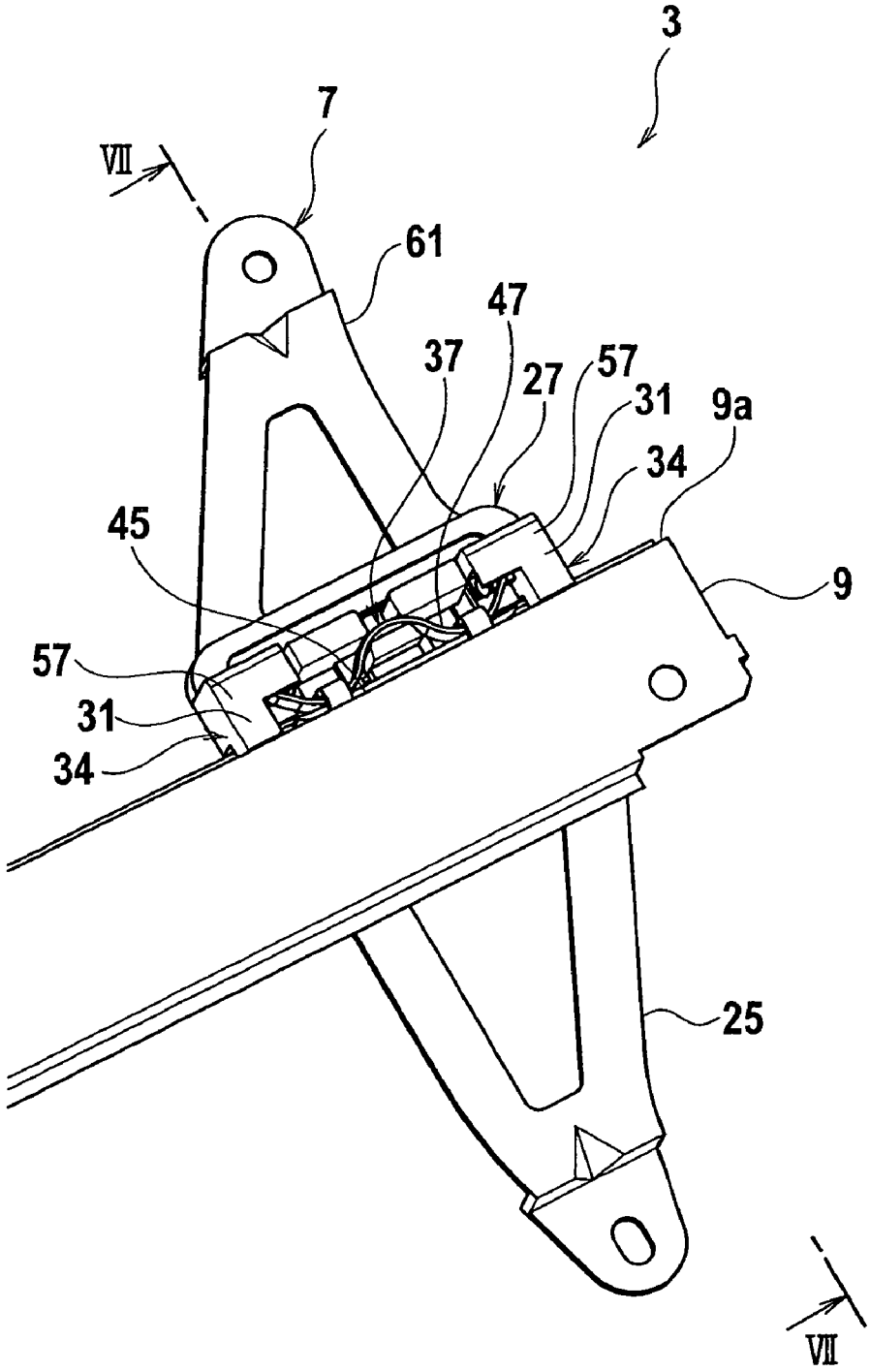
FIG. 4 is a perspective view showing a carrier and a guide rail of the window regulator according to the first embodiment of the present invention.
Figure 5:
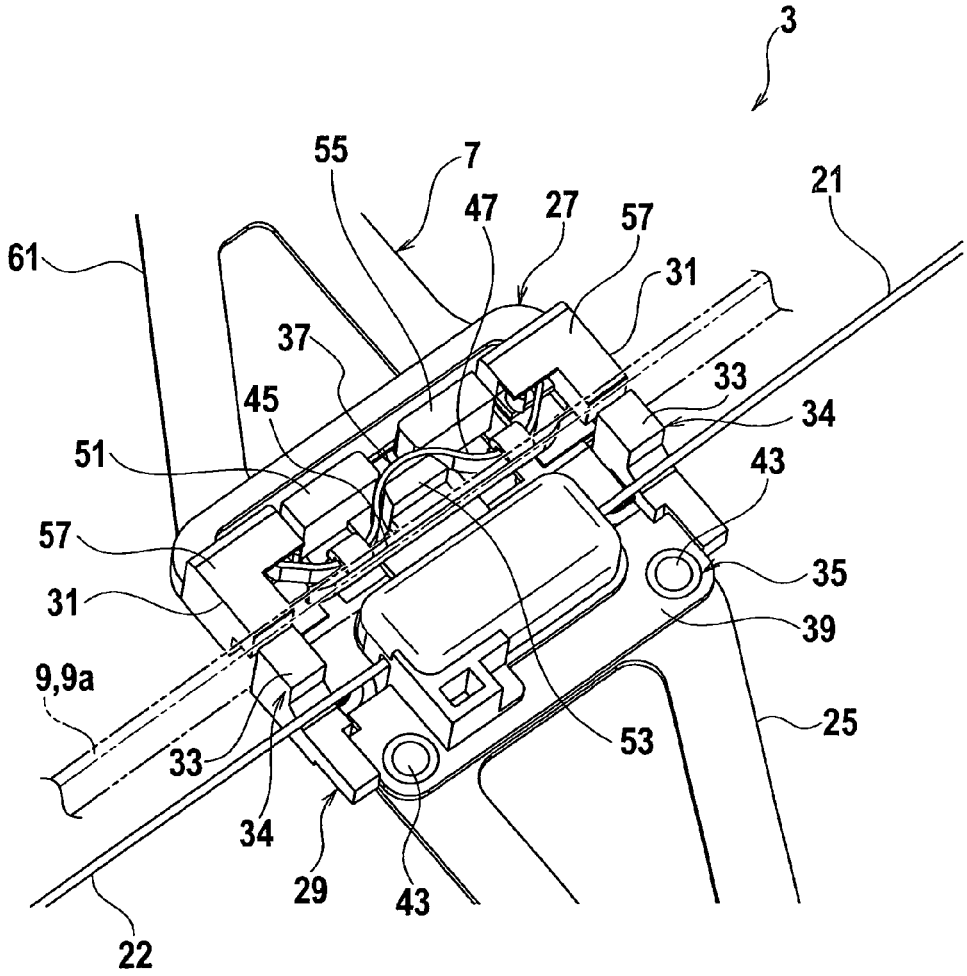
FIG. 5 is a perspective view showing relations among the carrier, the guide rail and a wire of the window regulator according to the first embodiment of the present invention.

As shown in FIGS. 2 and 3, the window regulator 3 includes a guide rail 9 extending vertically, a carrier 7 that can be slide vertically along the guide plate 9 and supports the window panel 5, and a drive unit 11 connected with the carrier 7 by a wire 21 for moving up (up-wire) and another wire 22 for moving down (down-wire). The window regulator 3 is configured to move the carrier 7 up and down along the guide rail 9 by drawing the up-wire 21 or the down-wire 22 using the drive unit 11.

The drive unit 11 includes a motor 13 that can conduct both of a positive rotation and a negative rotation, and a rotor drum 16 rotatably housed in a drum case 15.

The up-wire 21 is wound around the rotor drum 16 with one end thereof being fixed on the rotor drum 16. The down-wire 22 is also wound around the rotor drum 16 with one end of thereof being fixed on the rotor drum 16. However, the wound directions of the up-wire 21 and the down-wire 22 are opposite each other. The rotor drum 16 is coupled with the motor 13 via a reduction unit (not shown, e.g. a set of reduction gears) and rotationally driven by the motor 13.

Figure 7:
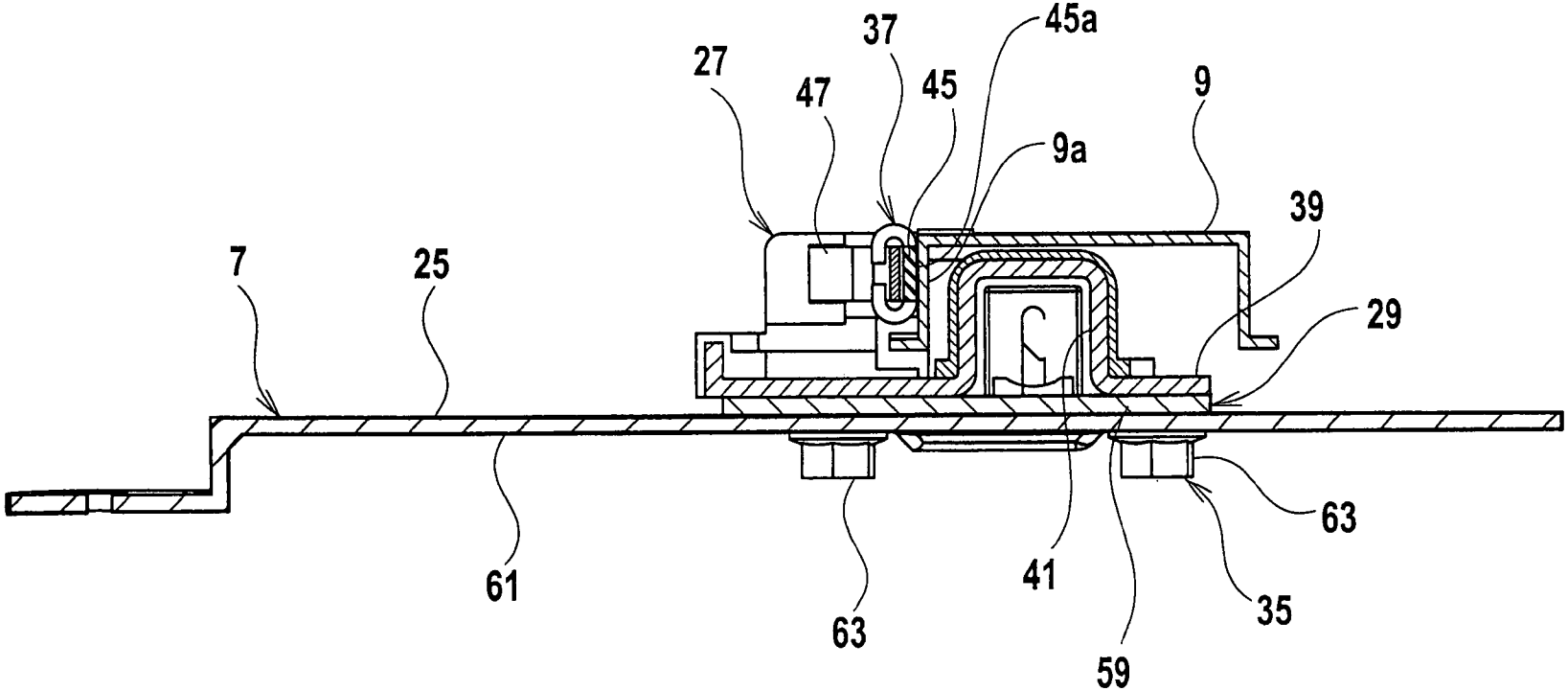
FIG. 7 is a cross-sectional view taken along line VII-VII shown in FIG. 4.

As shown in FIG. 1, the guide rail 9 is located vertically in the inside of the door 1 and fixed on the door 1 via brackets 17. More precisely, the guide rail 9 extends vertically with being slightly inclined backward. The cross-sectional shape of the guide rail 9 is formed as a hat-like shape as shown in FIG. 7. The guide rail 9 has a guide wall 9*a* extending vertically. The carrier 7 slides on the guide wall 9*a*.

As shown in FIGS. 2 and 3, an up-wire guide 19 that supports the up-wire 21 is provided on the upper end of the guide rail 9. The up-wire guide 19 is a pulley. On the other hand, a down-wire guide 20 that supports the down-wire 22 is provided on the lower end of the guide rail 9.

The up-wire 21 is fixed on the rotor drum 16 at its one end with being led upward and run around the up-wire guide 19 to change its extending direction downward. The other end of the up-wire 21 is fixed on the carrier 7. On the other hand, the down-wire 22 is fixed on the rotor drum 16 at its one end with being led downward and run through the down-wire guide 20 to change its extending direction upward. The other end of the down-wire 22 is fixed on the carrier 7.

As shown in FIGS. 5 to 8, the carrier 7 includes a carrier plate 25 with which the window panel 5 is coupled via holders 23 (see FIG. 1), a carrier main body 27 mounted on the carrier plate 25, and an aligning plate 29 provided between the carrier plate 25 and the carrier main body 27. In addition, the carrier 7 includes a holding section 34 that is slidably coupled with the guide rail 9, an aligning mechanism 35, and a brake mechanism 37. The holding section 34 is composed of two sets of a first slide block 31 and a second slide block 33. The aligning mechanism 35 relatively aligns the first slide blocks 31 and the second slide blocks 33.

Figure 8:
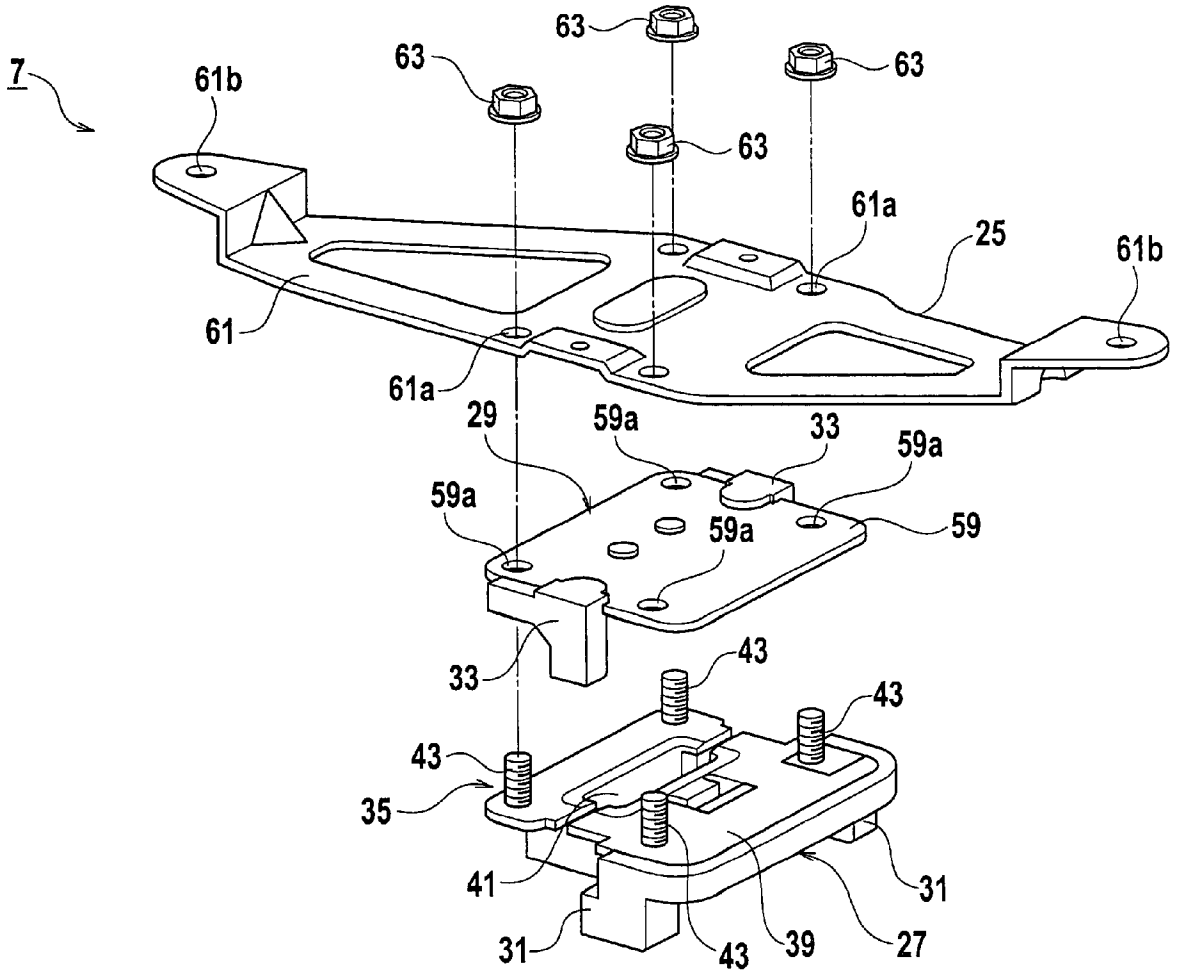
FIG. 8 is an exploded view of the carrier of the window regulator according to the first embodiment of the present invention.
Figure 9:
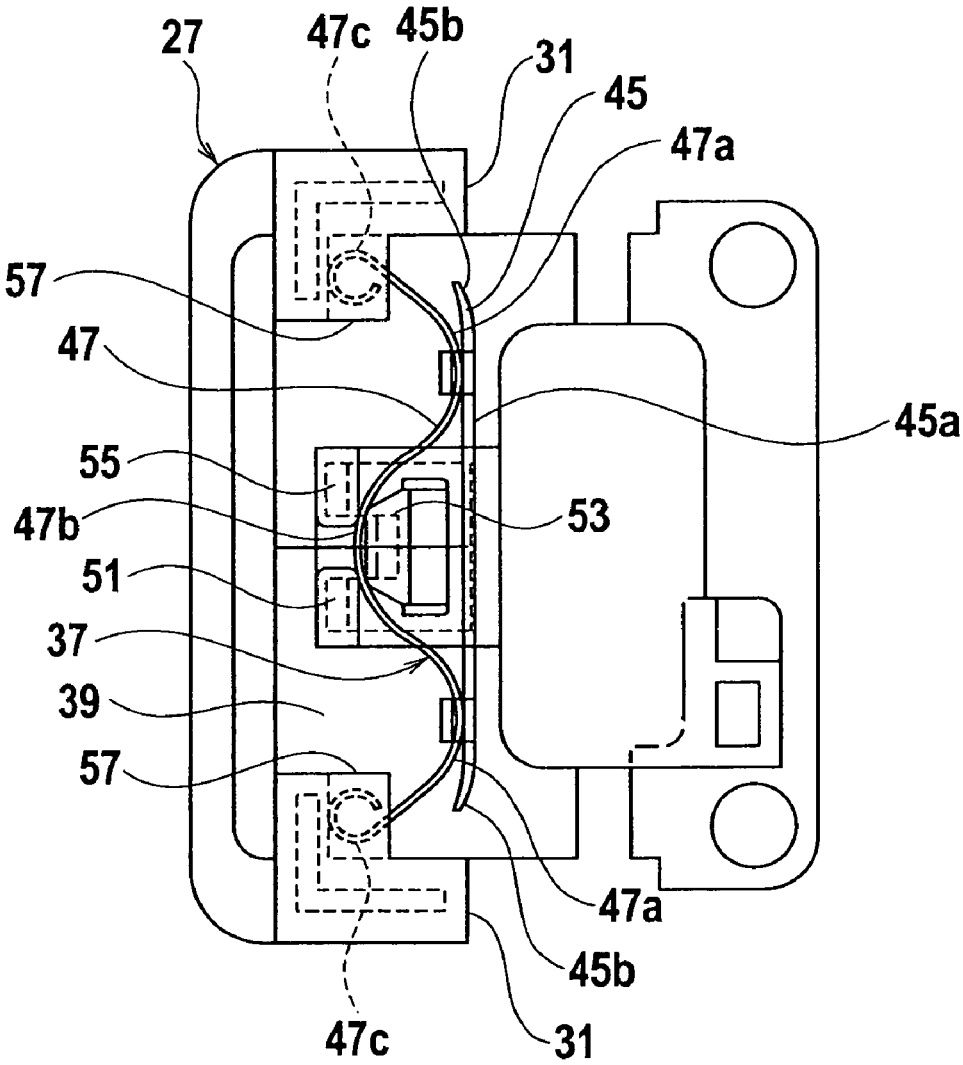
FIG. 9 is a side view of a carrier main body of the window regulator according to the first embodiment of the present invention.
Figure 10:
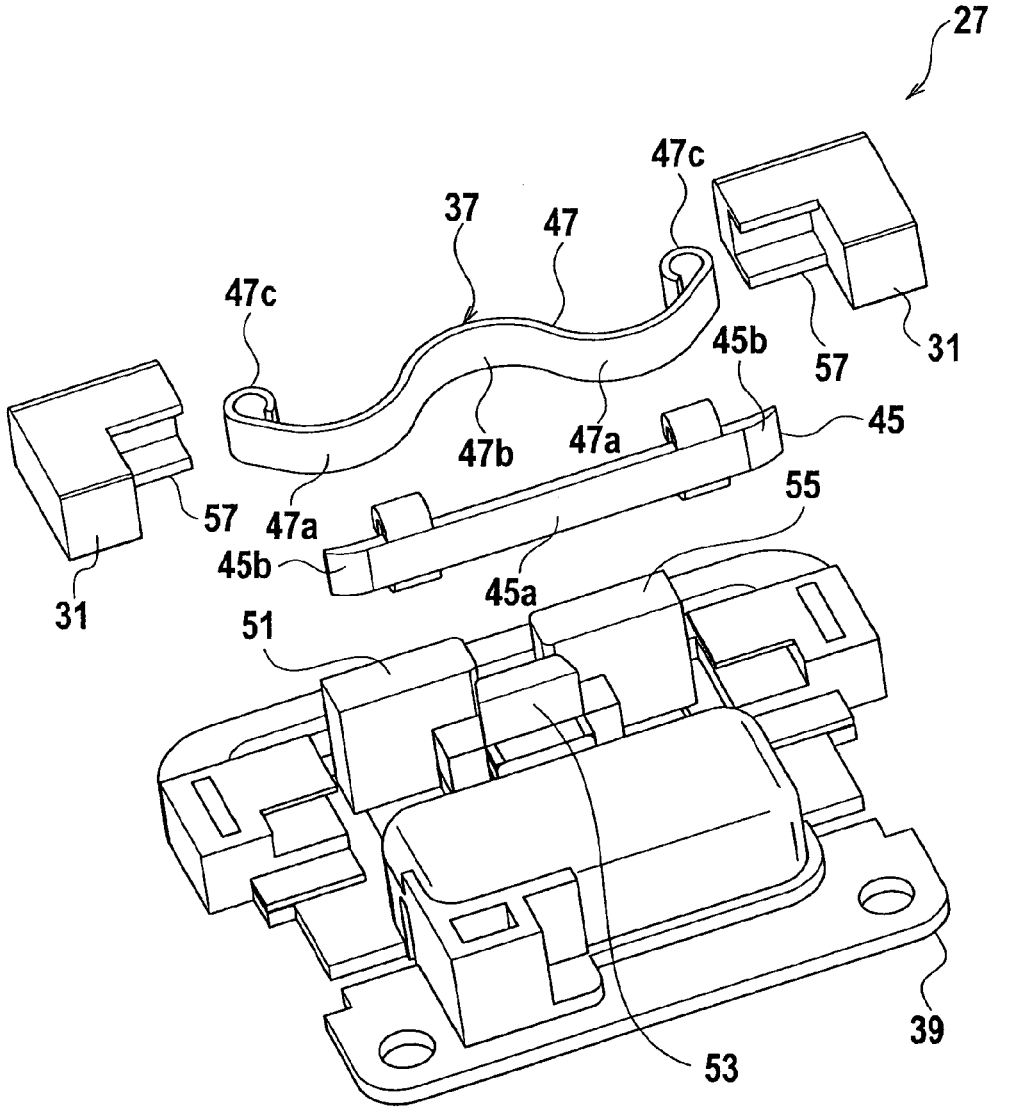
FIG. 10 is an exploded view of the carrier main body of the window regulator according to the first embodiment of the present invention.

As shown in FIGS. 8 to 10, the carrier main body 27 includes a base plate 39 of a steel plate, the first slide blocks 31, a housing section 41, and the brake mechanism 37.

Each of the first slide blocks 31 is provided with being contacted on one surface of the guide wall 9*a* of the guide rail 9 (see FIG. 5) and slides along a longitudinal direction (vertical direction) of the guide wall 9*a*. Each of the first slide blocks 31 is made of synthetic resin, for example, and mounted on the base plate 39 by outsert molding. The two first slide blocks 31 are provided along the guide wall 9*a* of the guide rail 9 with a distance therebetween (see FIG. 10).

As shown in FIG. 8, the housing section 41 is provided at a center portion of the carrier main body 27 on one side of the carrier main body 27 opposed to another side on which the guide rail 9 positions. The housing section 41 is, as well as the first slide block 31, made of synthetic resin, for example, and mounted on the base plate 39 by outsert molding. The housing section 41 houses terminal members (not shown) each fixed at the other end of the up-wire 21 and the other end of the down-wire 22. The housing section 41 is covered by the carrier plate 25 with interposing the aligning plate 29 therebetween while it houses the terminal members. Due to this structure, the other end of the up-wire 21 and the other end of the down-wire 22 are connected with the carrier 7.

Aligning bolts 43 are included in the aligning mechanism 35 and mounted at four corners of the base plate 39 of the carrier main body 27, respectively.

As shown in FIGS. 9 and 10, the brake mechanism 37 is slidably pressed on the guide rail 9 by an urging force for preventing the self-weight drop of the window panel 5. Specifically, the brake mechanism 37 includes a brake shoe 45 that can slide on a surface of the guide wall 9*a* of the guide rail 9 with being contacted with the guide wall 9*a*, and a leaf spring (a first urging member) 47 that presses the brake shoe 45 on the guide wall 9*a*. The brake mechanism 37 presses the brake shoe 45 thereof toward the guide rail 9 in a front-back direction of a vehicle, specifically toward backward.

The brake mechanism 37 is slidably pressed on the guide rail 9 by an urging force for preventing the self-weight drop of the window panel 5. Specifically, the brake mechanism 37 includes a brake shoe 45 that can slide on a surface of the guide wall 9*a* of the guide rail 9 with being contacted with the guide wall 9*a*, and a leaf spring (first urging member) 47 that presses the brake shoe 45 on the guide wall 9*a*. The brake mechanism 37 presses the guide wall 9*a* of the guide rail 9 in a front-back direction of a vehicle, specifically toward backward.

The leaf spring 47 is made by bending a belt-like plate. The leaf spring 47 includes a pair of bulged pressing sections 47*a* for pressing the brake shoe 45 and a bottom section 47*b* formed between the two pressing sections 47*a*. Both ends of the leaf spring 47 are rolled back so as to form rolled ends 47*c*, respectively. The bottom section 47*b* is coupled with first to third hold blocks 51, 53 and 55 that are formed on the base plate 39. The rolled ends 47*c* are supported by support sections 57 that are integrally formed on the first sliding block 31 of the base plate 39, respectively. As a result, the leaf spring 47 is aligned on the base plate 39 of the carrier main body 27. In other words, the leaf spring 47 is provided with its both ends being supported. Then, the brake shoe 45 is attached to the pressing section 47*a* via holders 49 (see FIG. 6). The leaf spring 47 is elastically deformed so as to expand vertically with being pressed by the brake shoe 45 that contacts on the surface of the guide wall 9*a* of the guide rail 9. As a result, reactive force to press the brake shoe 45 is generated by elastically restoring force of the leaf spring 47.

Figure 6:
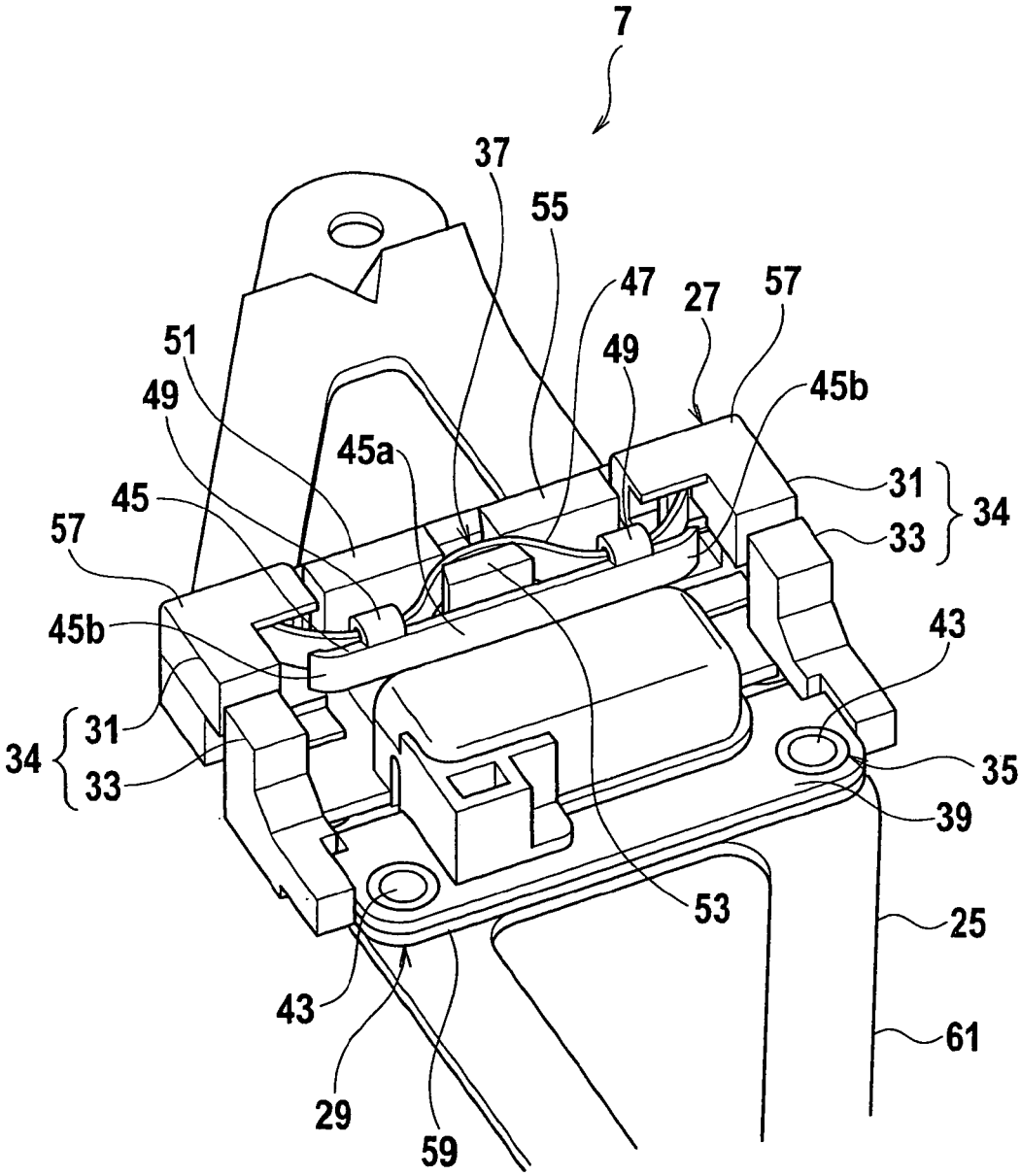
FIG. 6 is a perspective view of the carrier of the window regulator according to the first embodiment of the present invention.

As shown in FIGS. 6 and 8, the aligning plate 29 includes a base plate 59 made from a steel plate and the second slide blocks 33.

Each of the second slide blocks 33 is contacted on another surface of the guide rail 9*a* of the guide rail 9 (see FIG. 5) and slides along a longitudinal direction (vertical direction) of the guide wall 9*a*. Each pair of the first slide block 31 and the second slide block 33 holds the guide wall 9*a* therebetween. Each of the second slide blocks 33 is made of synthetic resin, for example, and mounted on the base plate 59 by outsert molding. The two second slide blocks 33 are provided along the guide wall 9*a* of the guide rail 9 with a distance therebetween (see FIGS. 5 and 6).

Aligning holes 59*a* are included in the aligning mechanism 35 and formed at four corners of the base plate 59 of the aligning plat 29, respectively. The aligning holes 59*a* are associated with the aligning bolts 43 of the carrier main body 27, respectively. Each of the aligning holes 59*a* is a through hole penetrating the base plate 59. Each of the aligning holes 59*a* is a hole elongated in a direction perpendicular to a sliding direction of the second slide blocks 33, in other words, a direction perpendicular to a the surface of the guide wall 9*a*. Each internal diameter of the aligning holes 59*a* is made larger at least than each outer diameter of the aligning bolts 43. Note that it is not necessary that each of the aligning holes 59*a* is an elongated hole. Each of the aligning holes 59*a* may be formed as a circular hole or an ellipsoidal hole.

As shown in FIG. 8, the carrier plate 25 is composed of a base plate 61 made of steel. Aligning holes 61*a* are provided at positions associated with the aligning bolts 43, respectively. Each of the aligning holes 61*a* is a through hole for fixing the carrier plate 25 with the carrier main body 27 with interposing the aligning plate 29 therebetween by the aligning bolts 43 and nuts 63. The nuts 63 are also included in the aligning mechanism 35. The carrier plate 25 extends laterally from its center so as to have a wings-like shape. Mounting holes 61*b* are provided at both ends of the carrier plate 25. The holders 23 (see FIG. 1) are coupled with the carrier plate 25 by the bolts (not shown) inserted into the mounting holes 61*b* and nuts (not shown).

As shown in FIG. 8, the aligning mechanism 35 includes the aligning bolts 43 mounted on the carrier main body 27, the aligning holes 59*a* formed on the aligning plate 29 and the nuts 63. The aligning mechanism 35 fixes the carrier main body 27 and the aligning plate 29 while the aligning plate 29 can be aligned to the carrier main body 27. Since the aligning holes 59*a* are formed as elongated holes as explained above, the aligning mechanism 35 can align the aligning plate 29 so as to align the first slide blocks 31 and the second slide blocks 33 in a direction perpendicular to the guide wall 9*a*. Therefore, the first slide blocks 31 and the second slide blocks 33 are aligned to the guide wall 9*a*.

Next, assembling process of the window regulator 3 will be explained hereinafter. First, the first slide blocks 31 of the carrier main body 27 are contacted on the surface of the guide wall 9*a* of the guide rail 9. Under the above state, the terminal members of the up-wire 21 and the down-wire 22 are housed in the housing section 41. Then, the aligning mechanism 35 is employed. Specifically, the aligning bolts 43 of the carrier main body 27 are inserted into the aligning holes 59*a* of the aligning plate 29, respectively, so as to fit the aligning plate 29 to the carrier main body 27 temporally. Then, the first slide blocks 31 of the carrier main body 27 are pressed on the surface of the guide wall 9*a* by an assembling device (not shown) with the carrier main body 27 and the aligning plate 29 being lapped. And this state is held on the assembling device.

Subsequently, the second slide blocks 33 of the aligning plate 29 are slid by the assembling device so as to contact the second slide blocks 33 on the other surface of the guide wall 9*a*. The second slide blocks 33 are pressed onto the other surface of the guide wall 9*a* with a preset constant load. Therefore, the guide wall 9*a* are held between the first slide blocks 31 and the second slide blocks 33. Then, the aligning holes 61*b* of the carrier plate 25 are inserted into the aligning bolts 43 and then the nuts 63 are fastened to the aligning bolts 43, respectively. Specifically, the nuts 63 are securely fastened to the aligning bolts 43 with the carrier main body 27 and the aligning plate 29 being lapped. Assembling the carrier 7 is completed after a sequence of these processes.

Here, the above-mentioned assembling device may include first push rods for the first slide blocks 31, second push rods for the second slide blocks 33, a first air cylinder for the first push rods, and a second air cylinder for the second push rods, for example. Then, the first slide blocks 31 are pressed onto the surface of the guide wall 9*a* by the first push-rods driven by the first air cylinder and the second slide blocks 33 are pressed onto the other surface of the guide wall 9*a* by the second push-rods driven by the second air cylinder.

According to the carrier 7, the aligning mechanism 35 relatively aligns the first slide blocks 31 and the second slide blocks 33 by pressing them onto the guide wall 9*a* to hold the guide wall 9*a* between the first slide blocks 31 and the second slide blocks 33. In other words, the guide wall 9*a* of the guide rail 9 is located between the first slide blocks 31 and the second slide blocks 33 with "zero" gap. The window regulator 3 is installed in the door 1 and then the window panel 5 is attached to the carrier 7 of the window regulator 3.

In the window regulator 3 having the above configuration, when the motor 13 of the drive unit 11 rotates in a positive rotational direction, the rotor drum 16 is rotated in the positive rotational direction so as to wind up the up-wire 21 therearound and feed out the down-wire 22 therefrom. Namely, the drive unit 11 pulls the up-wire 21. At that time, the drive unit 11 winds up (pulls) the up-wire 21 around the rotor drum 16 against the pressing force to the guide rail 9 of the brake mechanism 37. As a result, the carrier 7 is moved upward along the guide rail 9 and the window panel 5 is moved upward along with the carrier 7. On the other hand, when the motor 13 rotates in a negative rotational direction, the rotor drum 16 is rotated in the negative rotational direction so as to wind up the down-wire 22 therearound and feed out the up-wire 21 therefrom. Namely, the drive unit 11 pulls the down-wire 22. At that time, the drive unit 11 winds up (pulls) the down-wire 22 around the rotor drum 16 against the pressing force to the guide rail 9 of the brake mechanism 37. As a result, the carrier 7 is moved downward along the guide rail 9 and the window panel 5 is moved downward along with the carrier 7.

A situation will be explained hereinafter, where the holding section 34 of the carrier 7 becomes worn after a long term use of the window regulator 3, so that a gap(s) may be occurred between the holding section 34 and the guide rail 9 and may become large (i.e. friction between the holding section 34 and the guide rail 9 reduces). According to the present embodiment in such a situation, even when the full-opened window panel 5 is moved downward by winding up the down-wire 22 around the rotor drum 16 and feeding out the up-wire 21 from the rotor drum 16 and then the up-wire 21 comes loose, the brake mechanism 37 can prevent the window panel 5 from dropping down due to its weight (self-weight drop). The brake mechanism 37 prevents the window panel 5 from its self-weight drop by the friction between the guide wall 9*a* of the guide rail 9 and the brake shoe 45 pressed onto the guide wall 9*a* slidably.

In the window regulator 3 according to the present embodiment, the brake mechanism 37 prevents the self-weight drop of the window panel 5 by being slidably pressed on the guide rail 9 by the urging force. Therefore, even if a slidably contacting portion(s) (the holding section 34) of the carrier 7 that contacts with the guide rail 9 becomes worn, the window panel 5 doesn't drop due to its weight and thereby it is prevented that down speed or down movement of the window panel 5 goes wrong. As a result, good down operations of the window panel 5 can be maintained. Since prevented is alternating repetition of the down movement of the window panel 5 due to its weight and the down movement of the window panel 5 due to a tractive power of the down-wire, it is prevented that vibrations (judders) of the window panel S occur due to the self-weight drop of the window panel 5. Therefore, it is prevented that a vehicle passenger feels anomalous.

In the present embodiment, the brake mechanism 37 includes the brake shoe 45 that is slidably pressed onto the guide rail 9, and the leaf spring (the first urging member) 47 that urges the brake shoe 45 toward the guide rail 9 by its urging force to press the brake shoe 45 on to the guide rail 9. Therefore, the brake mechanism 37 can be adopted according to various types of the window panel 5 by setting friction coefficient between the brake shoe 45 and the guide rail 9 and/or spring constant of the leaf spring 47.

In the present embodiment, since the first urging member for urging the brake shoe 45 onto the guide rail 9 is the leaf spring 47 that has the two bulged pressing sections 47*a*, the brake shoe 45 can be pressed effectively with relatively simple mechanism.

In the present embodiment, since the brake mechanism 37 presses the brake shoe 45 thereof toward the guide rail 9 not in a width direction of a vehicle but in a front-back direction of a vehicle, an arrangement flexibility of the carrier 7 with relation to the guide rail 9 along a width direction of a vehicle can be ensured.

[Second Embodiment]

Figure 11:
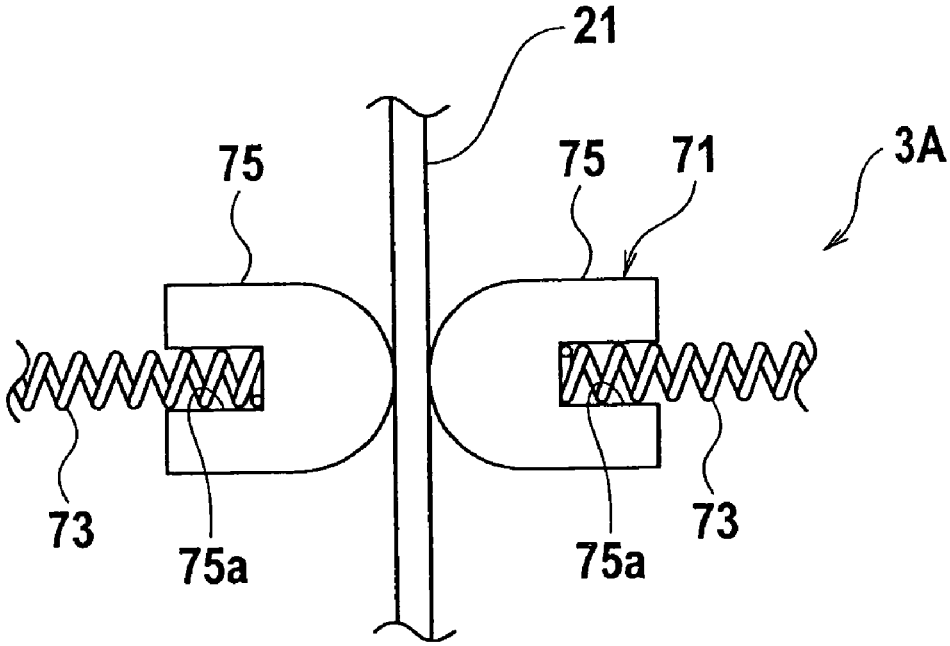
FIG. 11 is a schematic view of a loose preventing mechanism and an up-wire of a window regulator according to a second embodiment of the present invention.

Subsequently, a second embodiment of the present invention will be explained hereinafter with reference to FIG. 11. Note that the same components as those in the first embodiment are allocated to identical numerals and their explanations are omitted.

A window regulator 3A in the present embodiment is different from the window regulator 3 in the first embodiment includes in that the window regulator 3A includes a anti-loose mechanism 71 for preventing the up-wire 21 from coming loose instead of the brake mechanism 37. Other configurations are the same as those in the first embodiment.

The anti-loose mechanism 71 is located between the drive unit 11 and the carrier 7 on a string path of the up-wire 21 to hold the up-wire 21. The anti-loose mechanism 71 prevents the up-wire 21 from coming loose in a section between a held point of the up-wire 21 and the carrier 7.

Specifically, the anti-loose mechanism 71 includes coil springs (a second urging member) 73, and a pair of holding members 75 for holding the up-wire 21 therebetween by an urging force of the pair of coil springs 73. The anti-loose mechanism 71 is provided separately from the rotor drum 16 or the up-wire guide 19. Each of the holding members 75 is made of resin, for example.

The coil spring 73 are provided one by one for the holding members 75. One end of each of the coil springs 73 is supported by a supporter (not shown) fixed on the guide rail 9 and another end of the coil springs 73 is inserted into a recess 75*a* formed on each of the holding members 75. The coil springs 73 function as compression springs. Each of the coil springs 73 presses each of the holding members 75 onto the up-wire 21 by its urging force. Therefore, the pair of holding members 75 holds the up-wire 21 therebetween.

The anti-loose mechanism 71 allows the up-wire 21 passing through the pair of holding members 75 in a case where the up-wire 21 being held by the pair of holding members 75 is drawn by the rotor drum 16 (specifically, the down-wire 22 is wound up around the rotor drum 16 to move the carrier 7 downward and the up-wire 21 is drawn by the rotor drum 16 via the carrier 7 and the down-wire 22) and in another case where the up-wire 21 is wound up around the rotor drum 16 and the up-wire 21 is directly drawn by the rotor drum 16.

A situation will be explained hereinafter, where the holding section 34 of the carrier 7 becomes worn after a long term use of the window regulator 3, so that a gap(s) may be occurred between the holding section 34 and the guide rail 9 and may become large (i.e. friction between the holding section 34 and the guide rail 9 reduces). According to the present embodiment in such a situation, even when the full-opened window panel 5 is moved downward by winding up the down-wire 22 around the rotor drum 16 and feeding out the up-wire 21 from the rotor drum 16 and then the up-wire 21 comes loose even at a section between the rotor drum 16 and the anti-loose mechanism 71, the anti-loose mechanism 71 can prevent the up-wire 21 from coming loose at another section between the anti-loose mechanism 71 and the carrier 7. Specifically, the other section of the up-wire 21 between the anti-loose mechanism 71 and the carrier 7 is pulled with tension being applied (not loosen) because one end of the other section is held by the anti-loose mechanism 71 and another end of the other section (held on the carrier 7) is pulled by the rotor drum 16 via the down-wire 22. Therefore, the window panel 5 is supported by the up-wire 21 and thereby the window panel 5 is prevented from its self-weight drop. At this time, the up-wire 21 passes through the pair of holding member 75 with being pinched by the pair of holding member 75 while the up-wire 21 is drawn by the rotor drum 16 via the carrier 7 and the down-wire 22.

In the window regulator 3A according to the present embodiment, the anti-loose mechanism 71 prevents the self-weight drop of the window panel 5 because the anti-loose mechanism 71 prevents the up-wire 21 from coming loose in the section between the held point by the anti-loose mechanism 71 (by the pair of holding members 75) and the carrier 7. Therefore, even if a slidably contacting portion(s) (the holding section 34) of the carrier 7 that contacts with the guide rail 9 becomes worn, the window panel 5 doesn't drop due to its weight and thereby it is prevented that down speed or down movement of the window panel 5 goes wrong. As a result, good down operations of the window panel 5 can be maintained. Since prevented is alternating repetition of the down movement of the window panel 5 due to its weight and the down movement of the window panel 5 due to a tractive power of the down-wire, it is prevented that vibrations (judders) of the window panel 5 occur due to the self-weight drop of the window panel 5. Therefore, it is prevented that a vehicle passenger feels anomalous.

In the present embodiment, since the anti-loose mechanism 71 is located even between the drive unit 11 and the carrier 7 on a string path of the up-wire 21, an arrangement design flexibility of the anti-loose mechanism 71 can be ensured.

In the present embodiment, the anti-loose mechanism 71 includes the coil springs (the second urging member) 73 and the pair of holding members 75 for holding the up-wire 21 therebetween by an urging force of the pair of coil springs 73. Therefore, required holding force by the holding members 75 can be obtained easily by adjusting spring constant of the coil springs 73 at designing.

The present invention is not limited to the above-mentioned embodiments. The each configuration can be replaced with another configuration having the same functions within the scope of the present invention. For example, the so-called single-rail type window regulators 3 and 3A are explained in the above embodiments. However, the present invention may be adopted to a so-called double-rail type window regulator which has two guide rails.

In the first embodiment, the leaf spring 47 supported at its both ends is provided as the first urging member. However, the first urging member is not limited to this and may be a cantilevered leaf spring, a coil spring or the like.

In the first embodiment, the brake mechanism 37 that the brake shoe 45 thereof presses the guide rail 9 is adopted. However, the brake mechanism may directly press the guide rail 9 by the first urging member (the leaf spring 47) thereof.

In the second embodiment, the coil springs 73 are adopted as the second urging member. However, the second urging member is not limited to this and may be a leaf spring(s).

In the second embodiment, the anti-loose mechanism 71 that holds (pinches) the up-wire 21 is adopted. However, the anti-loose mechanism is not limited to this and may prevent the up-wire 21 from coming loose by restricting rotation of the rotor drum 16 or the up-wire guide (pulley) 19.

What is claimed is:

1. A window regulator, comprising:

a guide rail extending vertically;

a carrier for supporting a window panel, the carrier including a holding section in constant slidable contact with the guide rail and configured to slide along the guide rail;

a drive unit connected with the carrier by a wire and configured to move the carrier along the guide rail by drawing the wire; and a brake mechanism provided on the carrier and configured to prevent the window panel from dropping under its own weight, the brake mechanism comprising:

a brake shoe in constant slidable contact with one side surface of the guide rail, and a first urging member pressing the brake shoe onto said one side surface of the guide rail to maintain the constant slidable contact of the brake shoe with the side surface of the guide rail, and the holding section comprising a side block that in constant slidable contact with another side of the guide rail so that the brake shoe and the side block constantly slidably hold the guide rail therebetween.

2. The window regulator according to claim 1, wherein the first urging member is a leaf spring that includes two pressing sections each pressing the brake shoe.

3. A window regulator, comprising:

a guide rail extending vertically;

a carrier for supporting a window panel, the carrier including a holding section in constant slidable contact with the guide rail and capable of sliding along the guide rail;

a drive unit that includes a rotor drum connected with the carrier by an up-wire and a down-wire and is capable of (i) moving the carrier upward along the guide rail by winding up the up-wire around the rotor drum and feeding out the down-wire from the rotor drum or (ii) moving the carrier downward along the guide rail by winding up the down-wire around the rotor drum and feeding out the up-wire from the rotor drum, and an anti-loose mechanism that is provided on a string path of the up-wire between the drive unit and the carrier, the anti-loose mechanism holding the up-wire to prevent the up-wire from coming loose at a section between a held point of the up-wire and the carrier.

4. The window regulator according to claim 3, wherein the anti-loose mechanism includes a second urging member, and a pair of holding members holding the up-wire therebetween by an urging force of the second urging member.

* * * * *